US007291034B2

(12) United States Patent
Wu

(10) Patent No.: US 7,291,034 B2
(45) Date of Patent: Nov. 6, 2007

(54) CABLE CONNECTOR ASSEMBLY WITH INTERNAL PRINTED CIRCUIT BOARD

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,744

(22) Filed: Dec. 30, 2005

(65) Prior Publication Data

US 2007/0155218 A1 Jul. 5, 2007

(51) Int. Cl.
*H01R 13/627* (2006.01)

(52) U.S. Cl. ..... 439/358

(58) Field of Classification Search ..... 439/358, 439/352, 354, 353, 357, 344, 76.1
See application file for complete search history.

(56) References Cited

U.S. PATENT DOCUMENTS

| | | | | |
|---|---|---|---|---|
| 3,745,509 | A * | 7/1973 | Woodward et al. | 439/76.1 |
| 4,768,971 | A * | 9/1988 | Simpson | 439/329 |
| 5,764,487 | A * | 6/1998 | Natsume | 361/775 |
| 5,798,907 | A * | 8/1998 | Janik | 361/683 |
| 6,431,887 | B1 | 8/2002 | Yeomans et al. | |
| 6,585,536 | B1 * | 7/2003 | Wu | 439/358 |
| 6,585,537 | B1 | 7/2003 | Lee | |
| 6,617,939 | B1 * | 9/2003 | Vermeersch | 333/28 R |
| 6,655,979 | B1 | 12/2003 | Lee | |
| 6,821,139 | B1 | 11/2004 | Wu | |
| 6,830,472 | B1 | 12/2004 | Wu | |
| 6,857,912 | B2 | 2/2005 | Wu | |
| 6,860,749 | B1 | 3/2005 | Wu | |
| 6,860,750 | B1 | 3/2005 | Wu | |
| 6,890,205 | B1 | 5/2005 | Wu | |
| 6,896,540 | B1 | 5/2005 | Wu | |
| 6,926,553 | B2 | 8/2005 | Wu | |
| 2001/0044227 | A1 * | 11/2001 | Boutros et al. | 439/76.1 |
| 2003/0040202 | A1 * | 2/2003 | Norris et al. | 439/76.1 |

OTHER PUBLICATIONS

"SFF-8087 Specification for Compact Multilane Unshielded Connector" Rev. 1.31, published on Jun. 27, 2005 by SFF Committee.

* cited by examiner

*Primary Examiner*—Alexander Gilman
(74) *Attorney, Agent, or Firm*—Wei Te Chung

(57) ABSTRACT

A cable connector assembly (1000) includes a housing defining a mating direction, and defining a mating interface (11) and a receiving space, a printed circuit board (3) received in the receiving space, and having a plurality of electrical pads (31, 32) formed thereon, the printed circuit board defining a mating portion (30) accessible from the mating interface, a cable (4) with a plurality of conductors electrically attached to the electrical pads of the printed circuit board, and interengaging means arranged between the housing and the printed circuit board for locking the printed circuit board towards the housing reliably.

12 Claims, 9 Drawing Sheets

CABLE CONNECTOR ASSEMBLY WITH INTERNAL PRINTED CIRCUIT BOARD

CROSS-REFERENCE TO RELATED APPLICATION

This application is related to U.S. patent application Ser. No. 11/268,951 filed on Nov. 7, 2005, invented by Jerry Wu, entitled "CABLE CONNECTOR ASSEMBLY WITH INTEGRAL PRINTED CIRCUIT BOARD", which is assigned to the same assignee as this application.

BACKGROUND OF THE INVENTION

1. Field of the Invention

The present invention relates to a cable connector assembly, and more particularly to a cable connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8087 defines physical interface and general performance requirements of the mating interface for a Compact Multilane Connector which is designed for using in high speed serial interconnect applications at speeds up to 10 Gigabits/second. The Compact Multilane Connector defined in the SFF-8087 comprises a printed circuit board, a plurality of high-speed cables and low-speed wires respectively electrically connected with the printed circuit board to form a plurality of junctions therebetween, a PVC housing overmolding to the printed circuit board and the cables. The PVC housing comprises a rectangular body portion enclosing the junctions and a pair of tongue portions respectively extending forwardly from the body portion. The front portion of the printed circuit board is exposed between the pair of tongue portions for electrically connecting with a complementary connector. The Compact Multilane Connector also comprises a latch member assembled to a top surface of the body portion of the housing for latching with the complementary connector.

However, PVC material is relatively soft and is not rigid, the printed circuit board received in the PVC housing may loose therefrom in a vibrative circumstance so as to influence an electrical connection. Furthermore, the specification generally defines electrical and mechanical requirements and high frequency performance requirements as well as outside connector dimensions for reference. Detailed structures of the connector are not provided, such as the connection between the printed circuit board and the housing, and the connector still has room to be improved for achieving perfect signal transmission effect or complying the requirements described in the SFF-8087 more coincidently.

Hence, an improved cable connector assembly is desired to address the problems stated above.

SUMMARY OF THE INVENTION

An object of the present invention is to provide a cable connector assembly for providing a reliable electrical connection with a complementary connector.

To achieve the above object, a cable connector assembly in accordance with the present invention comprises a housing defining a mating direction, and defining a mating interface and a receiving space; a printed circuit board received in the receiving space, and having a plurality of electrical pads formed thereon, the printed circuit board defining a mating portion accessible from the mating interface; a cable with a plurality of conductors electrically attached to the electrical pads of the printed circuit board, and interengaging means arranged between the housing and the printed circuit board for locking the printed circuit board towards the housing reliably.

Other objects, advantages and novel features of the invention will become more apparent from the following detailed description when taken in conjunction with the accompanying drawings.

DETAILED DESCRIPTION OF THE INVENTION

Figure 1:
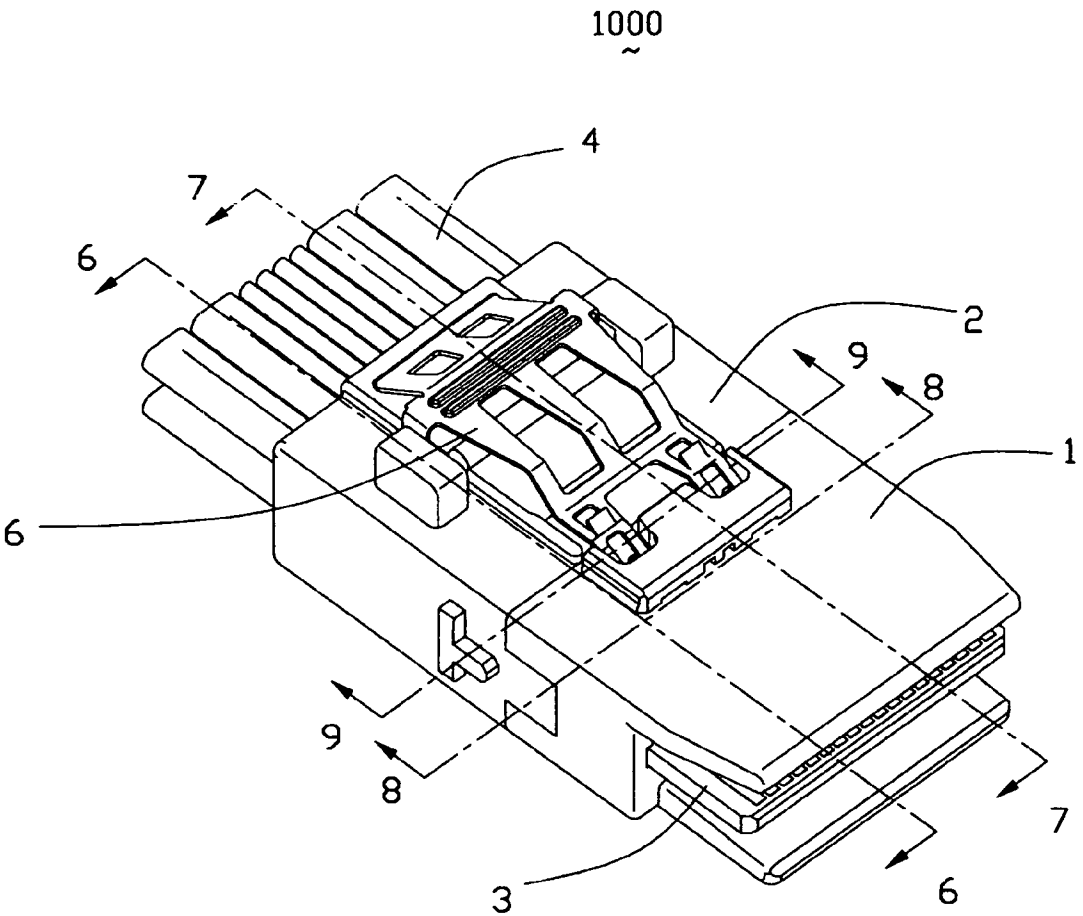
FIG. 1 is an assembled, perspective view of a cable connector assembly in accordance with the present invention.

Referring to FIG. 1, a cable connector assembly 1000 in accordance with the present invention comprises a housing (not labeled) defining a mating direction, a first housing 1 and a second housing 2 attached to the first housing 1 along the mating direction, a printed circuit board 3 received in the housing, a cable 4 attached to the printed circuit board 3, and a latch 6 formed on the housing for locking with a complementary connector (not shown).

Figure 7:
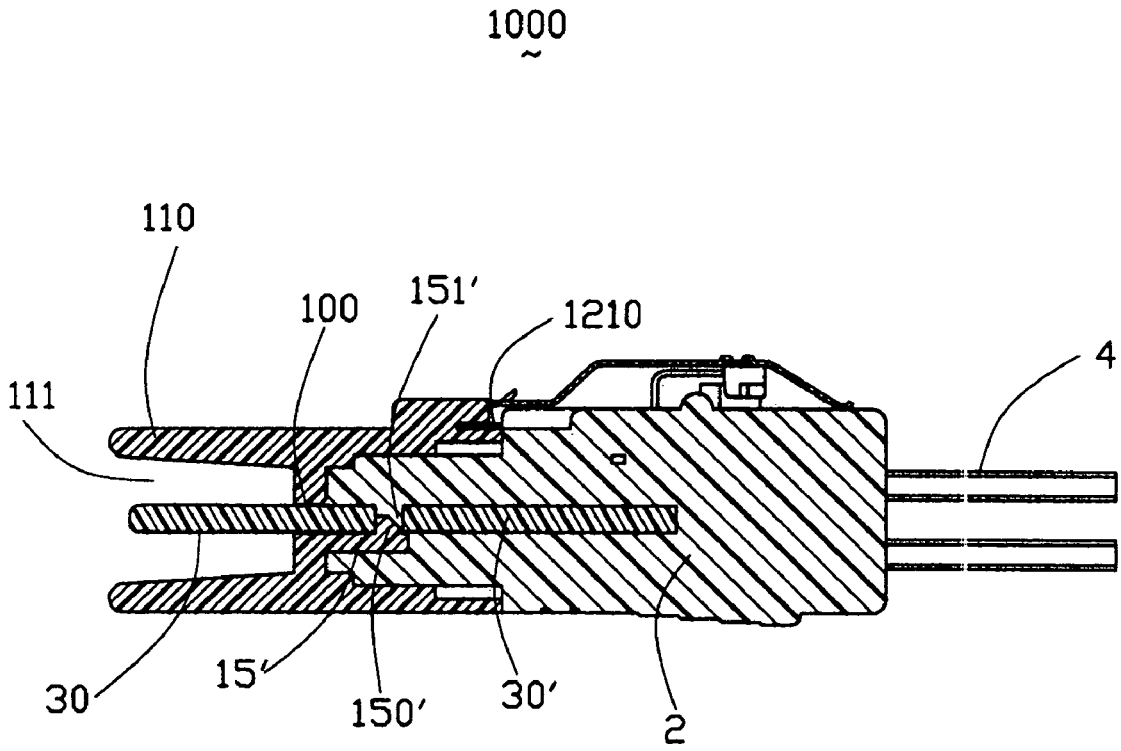

Referring to FIGS. 1-4, the first housing 1 is made of insulative material with enough rigidity or other material, such as metal. The first housing 1 comprises a rectangular body portion 10 defining a central receiving slot 100 (referring to FIG. 7) therethrough, and a mating interface 11 consisting of first and second tongue sections 110 respectively extending forwardly from a front surface 101 of the body portion 10 and an opening 111 formed between the first and second tongue sections 110 along a first direction perpendicular to the mating direction.

Figure 3:
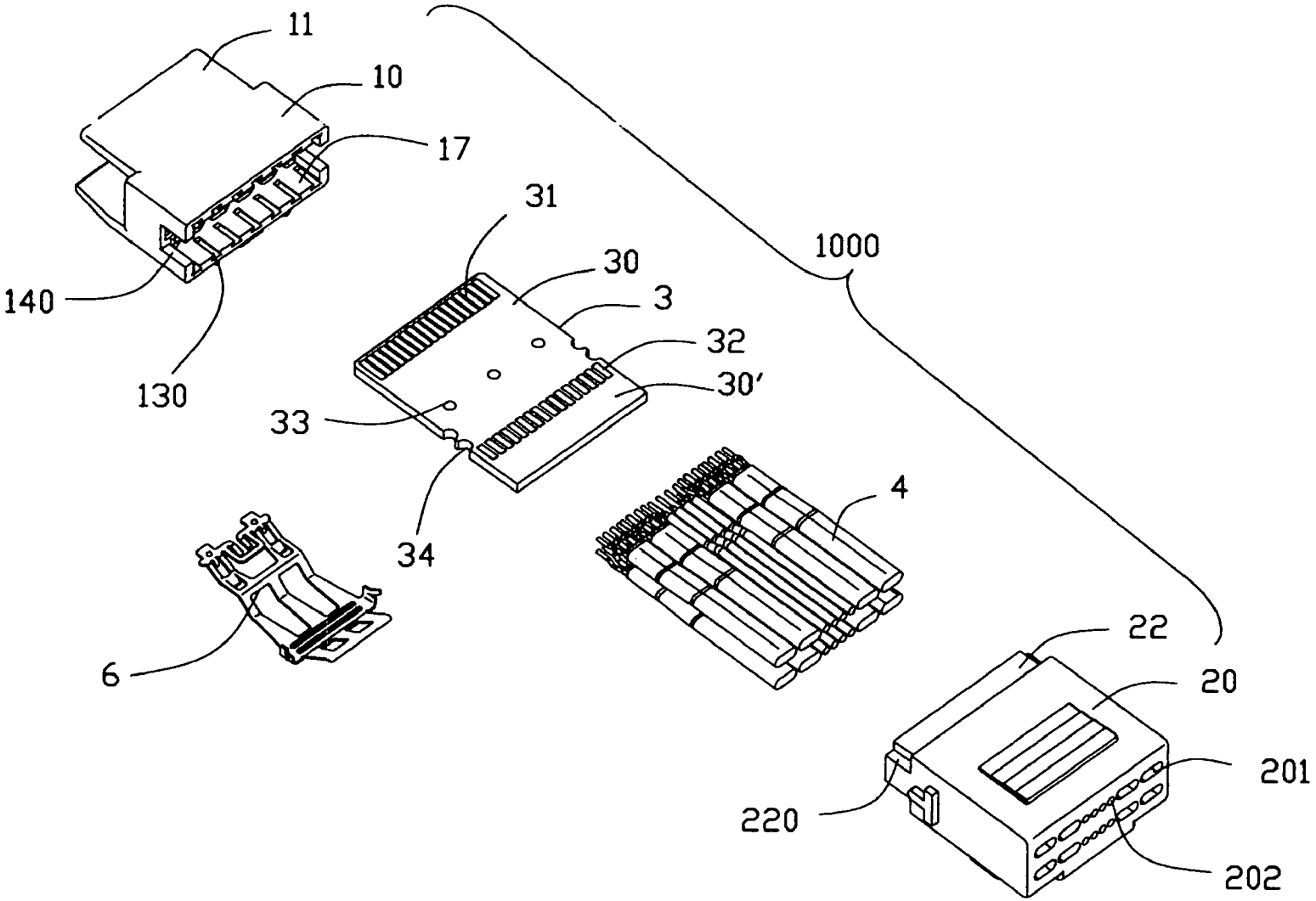
FIG. 3 is a view similar to FIG. 2, but taken from a different perspective.
Figure 4:
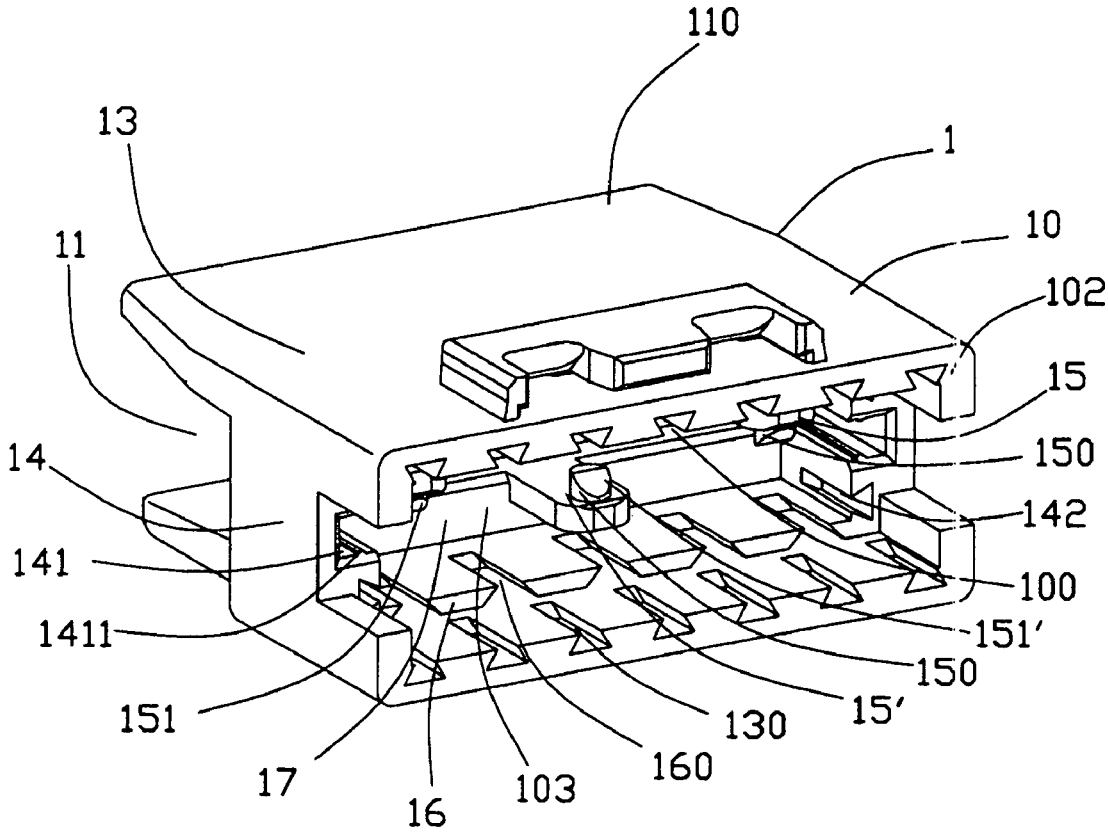
FIG. 4 is a perspective view of first housing of the cable connector assembly in accordance with the present invention.
Figure 8:
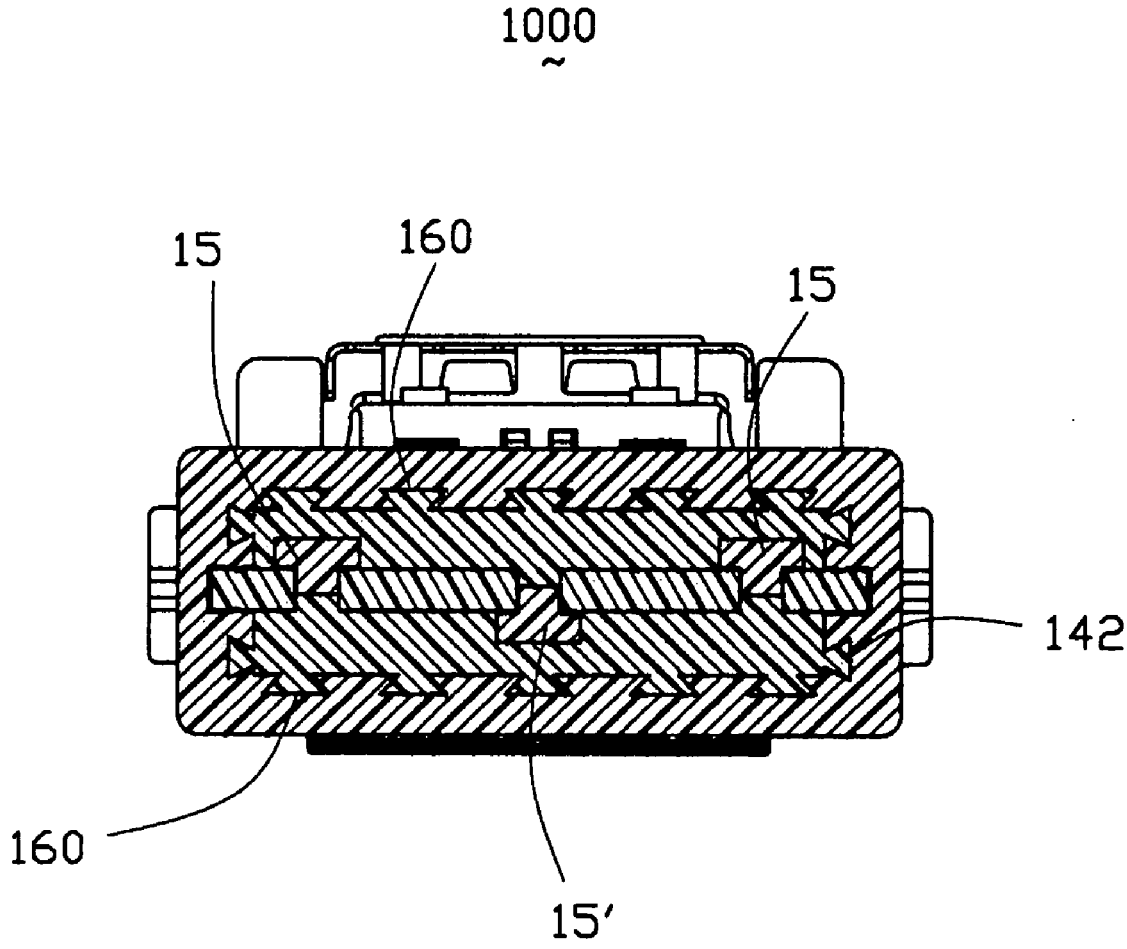
Figure 9:
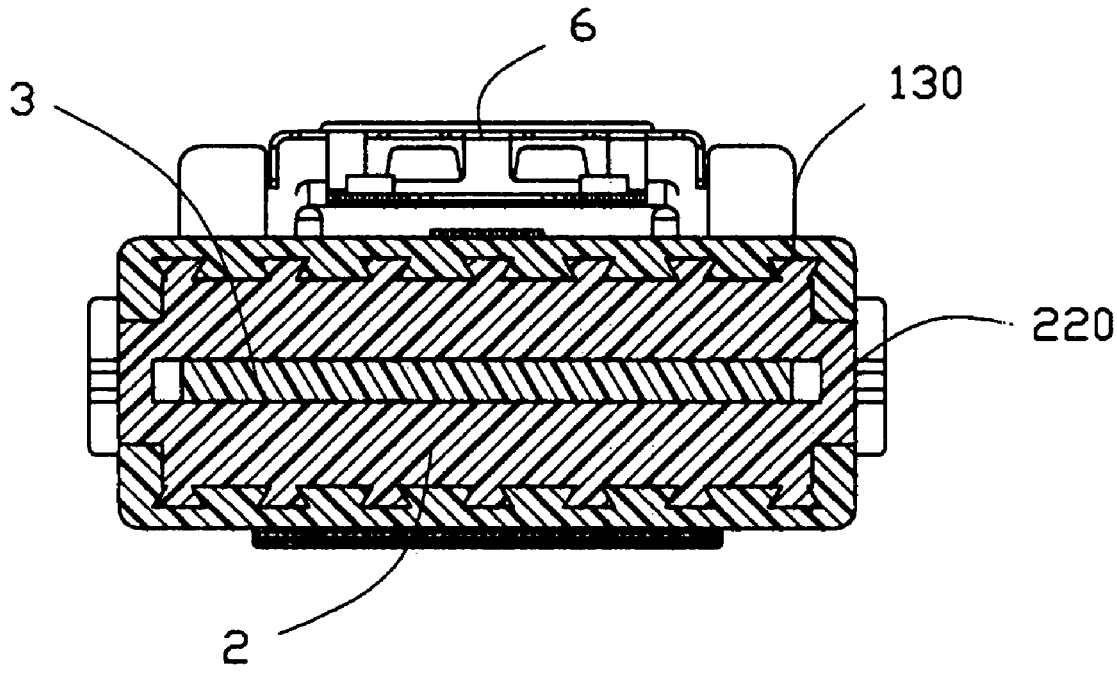

Referring to FIGS. 3-4 in conjunction with FIGS. 8-9, the body portion 10 defines a rectangular receiving recess 17 recessed forwardly from a rear surface 102 thereof to communicate with the receiving slot 100, and thus, forming a pair of longitudinal walls 13, a pair of lateral walls 14, and a front inner face 103. A pair of locking noses 15 extends rearwardly from the front inner face 103 with each locking nose 15 formed between the receiving slot 100 and one longitudinal wall 13 along the first direction and defining a post 150 with a slant 151 formed thereof. Similarly, a third locking nose 15' extends rearwardly from the front inner face 103 and is formed between the receiving slot 100 and the other longitudinal wall 13. This locking nose 15' located between the locking noses 15 along a direction perpendicular to the first direction and the mating direction also defines a post 150' opposite to the above posts 150 with a slant 151' formed thereof. Noticeably, between the pair of locking noses 150 and the third nose 150' along the first direction, the distance (not labeled) is large enough to allow the printed circuit board 3 to be inserted in. A pair of step tongues 16 extends from the front inner surface 103 of the body portion 10. Each step tongue 16 is formed between the corresponding locking nose 15, 15' and the longitudinal wall 13 and defines a plurality of first wedge-shape cuts 160 thereon. Each longitudinal wall 13 defines a plurality of second wedge-shape cuts 130 similar to the first wedge-shape cuts 160. Each lateral wall 14 defines a guiding cut 140 depressed forwardly a distance from the rear surface 102 of the body portion 10, a guiding slot 141 communicating with the receiving slot 100 with a plurality of ribs 1411 formed thereon for guiding the printed circuit board 3 to be inserted in, and a pair of third wedge-shape cuts 142 arranged in two opposite sides of the guiding slot 141 along the first direction.

Figure 2:
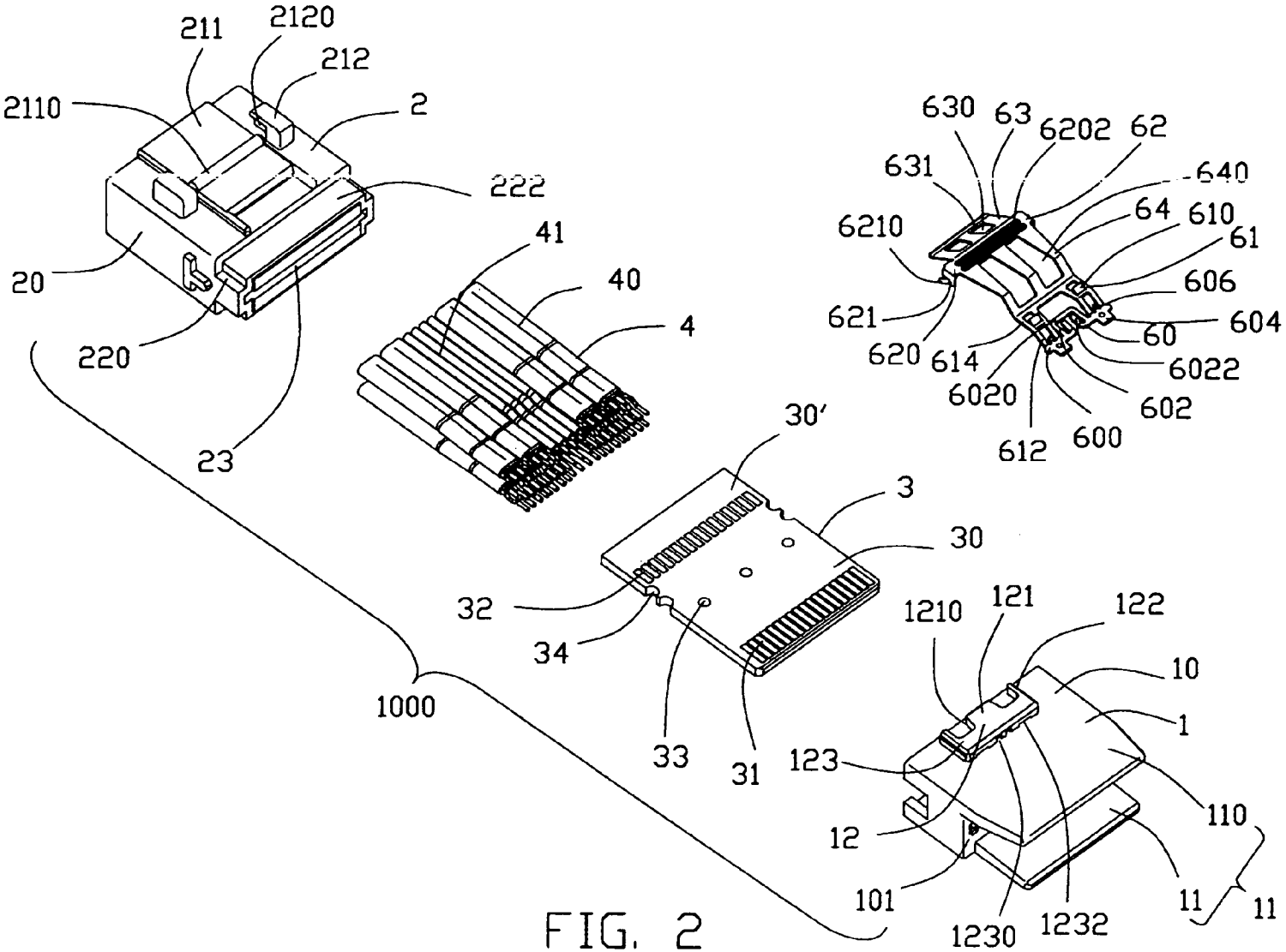
FIG. 2 is an exploded, perspective view of the cable connector assembly shown in FIG. 1.
Figure 5:
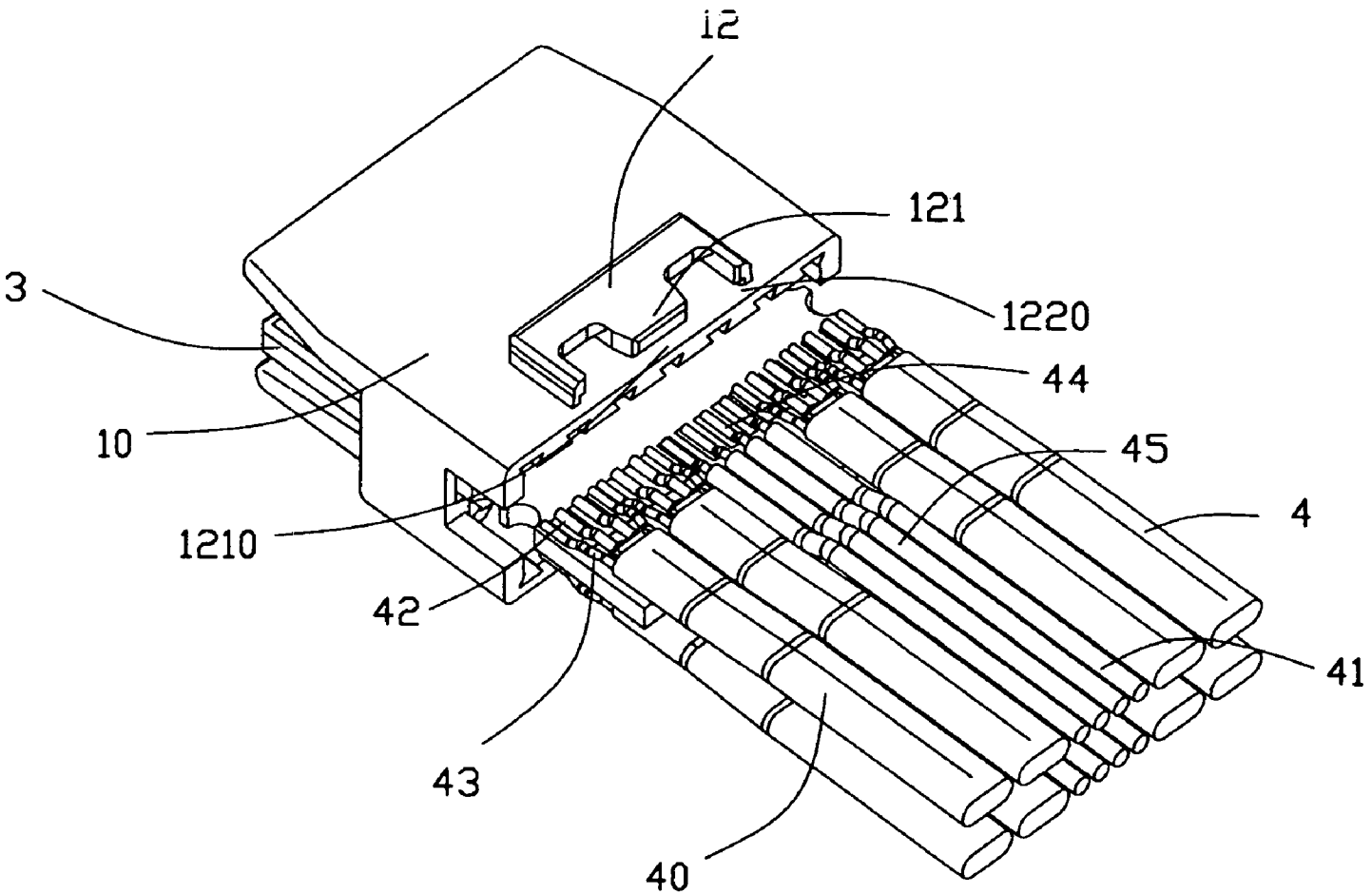
FIG. 5 is a partially assembled view of FIG. 2 with the printed circuit board and the cable attached to the first housing.

Referring to FIG. 2 in conjunction with FIG. 5, the body portion 10 forms an M-shape engaging portion 12 on a top surface and adjacent to the rear surface 102 thereof. The engaging portion 12 comprises a protruding section 121 and a pair of arms 122 located at opposite sides of the protruding section 121, all extending rearward from a transverse main section 123. A slit 1210 is formed between the protruding section 121 and a top surface of the body portion 10 and extends into the main section 123. A pair of grooves 1220 is respectively formed in the arms 122 and open toward each other. A pair of first slots 1230 and a pair of second slots 1232 located at opposite outer sides of the first slots 1230 are recessed from a front surface of the main section 123 to communicate with the slit 1210, respectively.

Figure 6:
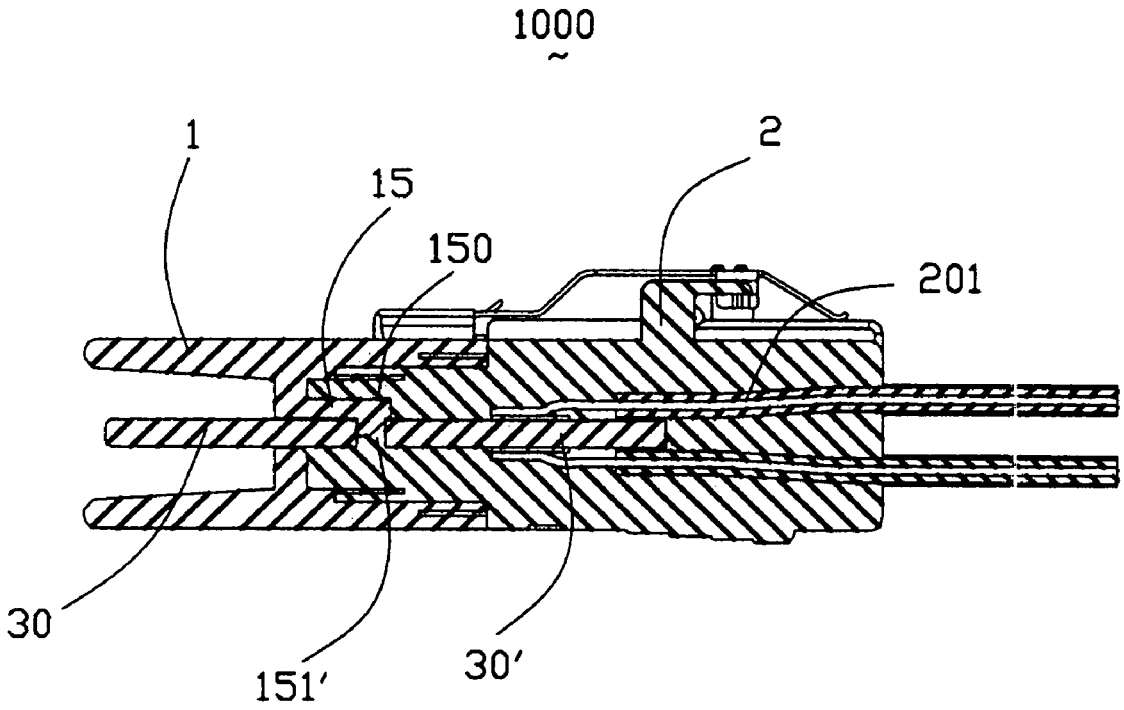
FIGS. 6-9 are cross-section views taken along lines 6-6 to 9-9 of FIG. 1.

Referring to FIGS. 2-3 in conjunction with FIG. 6, the second housing 2 of the present invention is made of PVC material. In other embodiments, the second housing 2 also can be made from other material, same as that of the first housing 1 or different from that of the first housing 1. The second housing 2 comprises a main portion 20 and a forwardly-projecting holding portion 22. The main portion 20 forms a flat extruding section 211 protruding upwardly from an upper surface thereof, and a pair of ear sections 212 located at opposite sides of the extruding section 211. The extruding section 211 forms a transverse bar-shape pivot section 2110 on middle thereof. A pair of recesses 2120 is respectively formed between the top surface of the main portion 20 and the pair of ear sections 212 with opening toward each other. The forwardly projecting holding portion 22 forms a pair of guiding projections 220 on opposite sides thereof for respectively engaging with the guiding cuts 140. The second housing 2 also defines a through slot 23 depressed rearwardly from a front surface thereof, and permeating through the forwardly projection holding portion 22 and into the main portion 20. The main portion 20 defines a plurality of first cable channels 201 and second cable channels 202 which arranged in two rows, depressed forwardly from a rear surface thereof and communicating with the through slot 23. The first cable channels 201 are arranged between the second cable channels 202 taken from a longitudinal direction perpendicular to the first direction and the mating direction.

Referring to FIG. 2, the printed circuit board 3 defines a mating portion 30, and a rear portion 30' opposite to the mating portion 30 along the mating direction, and forms a plurality of first conductive pads 31 at the mating portion 30 thereof and a plurality of second conductive pads 32 at the rear portion 30' thereof for providing signals transmission to the first conductive pads 31 by a plurality of conductive traces (not shown) attaching the first conductive pads 31 towards the second conductive pads 32. The conductive pads 31, 32 are arranged on opposite upper and lower surfaces of the printed circuit board 3. Three through holes 33 are disposed between the first and second conductive pads 31, 32 of the printed circuit board 3. A pair of through holes 33 of the three through holes 33 is arranged for locking with the locking noses 15 of the first housing 1 from one of the upper and lower surfaces of printed circuit board 3, and the third and middle through hole 33 is arranged for locking with the locking nose 15' from the other of the upper and lower surfaces of the printed circuit board 3. Each side edge of the printed circuit board 3 defines a pair of semi-circular positioning holes 34 arranged along the mating direction.

Referring to FIG. 2 in conjunction with FIG. 5, the cable 4 consist of two sets of sub-assemblies in a stacked relationship. Each set comprises four first cables 40 for high-speed signal transmission and four second cables 41 for low-speed signal transmission. Each first cable 40 comprises a pair of signal conductors 42 respectively transmitting positive signal and negative signal, and a pair of grounding conductors 43 arranged at opposite outer sides of the pair of signal conductors 42 for providing grounding to the signal transmission. Each second cable 41 comprises a single conductor 44 and a jacket 45 enclosing the single conductor 44.

Referring to FIGS. 2-3, the latch 6 is stamped and formed from a metallic plate and comprises a retaining portion 60, a pair of generally L-shape locking portions 61 extending upwardly and rearwardly from the retaining portion 60, a N-shape pressing portion 62 formed at a rear position of the pair of locking portions 61, and an inclined supporting portion 63 slantwise extending from the pressing portion 62. The latch 6 further forms a generally L-shape intermediate portion 64 connecting the pressing portion 62 with the locking portions 61.

The retaining portion 60 has a pair of transverse bar sections 600 respectively connecting with front edges of the locking portions 61, an engaging section 602 connecting with opposite inner ends of the pair of bar sections 600 and extending rearward from the bar sections 600, and a pair of positioning sections 604 respectively extending forwardly from front edges of the pair of bar sections 600. Outmost end of each bar section 600 extends beyond outmost edge of corresponding locking portion 61 and served as guiding means for the latch 6. The engaging section 602 is located between the pair of locking portions 61 and comprises a rectangular frame 6020 located in a horizontal surface and a pair of elastic snapping sections 6022 extending into the space circumscribed by the frame 6020 with distal ends bending upwardly. Each locking portion 61 comprises an inclined first section 612 extending rearward and upwardly from the retaining portion 60 and a flat second section 614 extending rearward from the first section 612 to connect with the intermediate portion 64. The inclined first section 612 defines a cutout therein for increasing flexibility thereof. The second section 614 is formed with a pair of latch sections 610 extending upwardly and rearward from a front portion thereof. A pair of stop sections 606 are respectively formed with the bar sections 600 and extend into the cutout (not labeled) of the first sections 612 and curve upwardly. The pressing portion 62 comprises a body section 620 and a pair of side beams 621 extending downwardly from opposite lateral ends of the body section 620. Each side beam 621 is formed with a spring tab 6210 extending outwardly therefrom. The body section 620 is formed with a plurality of ribs 6202 for facilitating handling. The supporting portion 63 defines a pair of rectangular openings 630 and forms a curved edge 631 at a free end thereof. The intermediate portion 64 defines a pair of elongated cutouts 640. The openings 630 and the cutouts formed in the second sections 614 of the locking portion 61 and the intermediate portion 64 are defined for perfect deformation of the locking portion 61 and the supporting portion 63.

Referring to FIGS. 1-10, in assembly of the cable connector assembly 1000, the two sets of cables 4 are respectively soldered to the printed circuit board 3 with the first and second cables 40, 41 electrically soldered with corresponding second conductive pads 32 located on the upper and lower surfaces of the printed circuit board 3. Then, inserting the printed circuit board 3 with the soldering cables 4 into the first housing 1, with the mating portion 30 of the printed circuit board 3 sliding along the guiding slot 141. Noticeably, during the process of the printed circuit board' sliding, a distance later, due to a guiding function provided by the slants 151, 151' of the locking noses 15, 15', the printed circuit board 3 will be inserted into the distance between the locking noses 15, 15' on opposite sides of the receiving slot 100. Because the thickness of the printed circuit board 3 is appreciably lager than the distance between the posts 150, 150' on opposite sides of the receiving slot 100 along the first direction, the upper and lower surfaces of the printed circuit board 3 will force the locking noses 15, 15' to move elastically outwardly by means of abutting against the posts 150, 150'. Later, the printed circuit board 3 is inserted into continuously with the mating portion 30 of the printed circuit board 3 extending through the receiving slot 100 and located in the opening 111 of the mating interface 11 for mating with the complementary connector until the holes 33 of the printed circuit board 3 is pushed to a position, where the posts 150, 150' faces to corresponding holes 33 of the printed circuit board 3 from the upper and lower surfaces of the printed circuit board 3 respectively, and therefore, lock with corresponding holes 33 for locking the printed circuit board 3 with the first housing 1 and preventing the printed circuit board 3 loosing from the first housing 1. Accordingly, the locking between the posts 150, 150' of the first housing 1 and the holes 33 of the printed circuit board 3, and the limitation of the guiding slot 141 that the two sides of the printed circuit board 3 is arranged restrictedly therein, functioned as interengaging means, make the printed circuit board 3 be attached to the first housing 1 reliably.

The second housing 2 is then over-molded to the first housing 1. During this molding process, the first housing 1 with the printed circuit board 3 and the cables 4 assembled therewith is located in a mold, the melted plastic material is injected into the receiving recess 17 of the first housing 1, encloses the rear portion 30' of the printed circuit board 3 and the front ends of cables 4, concomitantly, also encloses junctions between the second conductive pads 32 and the conductors of the cables 4. The melted plastic material flows into the wedge-shape cuts 160, 130 and 142 and the guiding cuts 140 of the first housing 1, and the semi-circular positioning holes 34 of the printed circuit board 3. After a cooling process, the second housing 2 is provided. The forwardly-projecting holding portion 22 is received in the receiving recess 17 of the first housing 1, the guiding projections 220 are respectively engaging with the corresponding guiding cuts 140, the wedge-shape cuts 160, 130 and 142 are locking with the second housing 2 by means of a combination between the wedge-shape cuts 160, 130 and 142 and the cooling material for providing an enough grasp therebetween, these structures together are useful to attach the second housing 2 to the first housing 1 reliably. In addition, the through slot 23 of the second housing 2 formed from the molding process can receive the rear portion 30' of the printed circuit board 3 therein. The receiving recess 17 of the first housing 1 and the through slot 23 of the second housing 2 together communicate with each other, functioned as the receiving space, for receiving the printed circuit board 3 therein. Noticeably, the printed circuit board 3 is wholly received in the receiving space and only accessible from the mating interface 11 of the first housing 1. In addition, the printed circuit board is integrally molded with the second housing 2 and cannot be separated from the second housing 2 easily. The first cables 40 and the second cables 41 are respectively received in corresponding first and second cable channels 201, 202. The junctions between the cables 40, 41 and the printed circuit board 3 are integrally over-molded by the second housing 2.

Particularly referring to FIGS. 1-5, the latch 6 is assembled to the first and second housings 1, 2. A forward pressing force is exerted on the latch 6. The spring tabs 6210 of the pressing portion 62 respectively slide along the recesses 2120 of the ear sections 212 of the second housing 2. At the same time, with the guidance of the outmost ends of the retaining portion 60 sliding along the grooves 1220 of the arms 122 of the first housing 1, the bar section 600 and the engaging section 602 are received in the slit 1210 with the positioning sections 604 and the snapping sections 6022 respectively locked into the first and the second slots 1230, 1232 to prevent the latch 6 from moving rearwardly when the cable connector assembly 100 mates with the complementary connector. The pair of stop sections 606 locate in front of the main section 123 for preventing excessive forward movement of the latch 6. The supporting portion 63 is located above the extruding section 211 of the second housing with the curved edge 631 abutting against a surface of the extruding section 211. The spring tabs 6210 of the pressing portion 62 elastically engage with inner surfaces of the recesses 2120 of the ear sections 212 for preventing the latch 6 from escaping the recesses 2120 of the second housing. The pressing portion 62 is downwardly movable relative to the rear portion of the second housing 2 to deflect the locking portion 61 toward the first and second housing 1, 2.

The complementary connector has corresponding structure locking with the pair of latch sections 610 of the latch 6 to realize the reliable engagement with the cable connector assembly 100. When the cable connector assembly 100 is to be separated from the complementary connector, a downward pressing force is exerted on the pressing portion 62 of the latch 6. The pressing portion 62 moves downwardly until the body section 620 contacts with the pivot portion 2110 of the second housing 2 and the locking portion 61 creates a vertical displacement toward the first housing 1. The body section 1620 then becomes curve toward the second housing 2 under the pressing force with the locking portion 161 creating a further vertical displacement. The retaining portion 60 engaging with the first housing 1 and the supporting portion 63 pressing on the second housing 2, thus, together form a girder. The vertical displacement of the locking portion 61, particularly the latch sections 610, is big enough to realize the unlock between the cable connector assembly 100 and the complementary connector easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector, comprising:

a housing defining a mating direction; and defining a mating interface and a receiving space, the mating interface comprising a pair of tongues extending a pre-selected distance from the housing, and an opening defined between the pair of tongues;

a printed circuit board received in the receiving space, and having a plurality of electrical pads formed thereon, the printed circuit board defining a mating portion received in the opening, and spaced from and being parallel to the pair of tongues;

a cable with a plurality of conductors electrically attached to the electrical pads of the printed circuit board; wherein said printed circuit board defines at least one circular through hole, and said housing defines respective locking noses commonly extending into said through hole; wherein the housing comprises a step tongue extending from a front inner surface thereof and into a receiving recess with a plurality of wedge-shape cuts therein.

2. The cable connector assembly as claimed in claim 1, wherein the housing comprises a first housing, and a second housing integrally over-molded with the first housing along the mating direction, the first housing and second housing together define the above receiving space.

3. The cable connector assembly as claimed in claim 1, wherein the housing comprises a longitudinal guiding slot that receives at least one side edge of the printed circuit board, and a transverse receiving slot communicating with the opening through which said printed circuit board extends to expose the mating portion thereof into the opening of the mating interface.

4. The cable connector assembly as claimed in claim 3, wherein the locking noses are arranged at two sides of the receiving slot respectively along a direction perpendicular to the mating direction, and form a distance large enough to allow the printed circuit board to be inserted in.

5. A cable connector assembly for mating with a complementary connector, comprising:

a housing defining a front half and a rear half assembled together;

a printed circuit board having a front portion disposed in the front half and a rear portion disposed in the rear half; and a cable with a plurality of conductors electrically connected to printed circuit board; wherein said printed circuit board defines at least one through hole, and said front half and said rear half define respective projections commonly extending into and sharing and fully filling said through hole.

6. The cable connector assembly as claimed in claim 5, wherein the projection of the front half is formed before extending into the through hole while the projection of the rear half is formed via overmolding said through hole under a condition that the projection of the front half already extends into said through hole.

7. A cable connector assembly for mating with a mating connector, comprising:

a connector housing, the connector housing including a front surface, and a first tongue extending from the front surface;

a printed circuit board, the printed circuit board including a mating portion with electrical pads for mating with the mating connector, and a rear portion with electrical pads for termination to a plurality of cables, said printed circuit board being disposed in said connector housing such that the mating portion of the printed circuit board extends from the front surface and spaces apart from the first tongue, the rear portion of the printed circuit board being disposed within said connector housing;

a plurality of cables terminated to electrical pads of the said rear portion of the printed circuit board; wherein said printed circuit board includes a plurality of through boles, said connector housing includes a plurality of locking noses, the locking noses commonly engages with said through holes from upper and lower surfaces of the printed circuit board respectively; wherein the connector housing comprises a longitudinal guiding slot that receives at least one side edge of said printed circuit board, and a transverse receiving slot through which said printed circuit board extends to expose the mating portion forwardly of said front surface of the connector housing; wherein said locking noses are disposed at two sides of the transverse receiving slot respectively in a lateral views with each locking nose including a post, wherein the posts disposed at one side of the transverse receiving slot direct to a reverse direction when compared with that disposed at the other side of the transverse receiving slot.

8. The cable connector assembly as claimed in claim 7, wherein the through holes of the printed circuit board arrange in a transverse line and within the inner thereof, and the through holes are flanked with respective posts formed on said locking noses.

9. The cable connector assembly as claimed in claim 7, wherein the connector housing has upper and lower walls defining a plurality of wedge-shape cuts for allowing a moldable insulative material to fill in.

10. The cable connector assembly as claimed in claim 7, wherein each post includes an angled lead-in configuration for guiding an insertion of said printed circuit board.

11. The cable connector assembly as claimed in claim 7, wherein the connector housing includes a first connector housing which defines a receiving recess by upper and lower walls thereof, and a second connector housing which includes a main portion, and a forwardly-projecting holding portion stepped relative to the main portion and received in the receiving recess.

12. The cable connector assembly as claimed in claim 11, wherein the housing comprises a step tongue extending from a front inner surface thereof and into the receiving recess with a plurality of wedge-shape cuts therein.

* * * * *